United States Patent [19]

Kolton et al.

[11] Patent Number: 5,069,373

[45] Date of Patent: Dec. 3, 1991

[54] GARMENT HANGER FOR STRAPPED GARMENTS WITH NOTCHING RETENTION

[75] Inventors: Chester Kolton, Westfield; Stuart S. Spater, Livingston, both of N.J.

[73] Assignee: A & E Products Group, a division of Carlisle Plastics, Inc., Woodbridge, N.J.

[21] Appl. No.: 580,589

[22] Filed: Sep. 11, 1990

[51] Int. Cl.[5] ..... A47G 25/30; A47G 25/48; A47G 25/28; A47G 25/14

[52] U.S. Cl. ..... 223/85; 223/91; D6/315; D6/326

[58] Field of Search ..... 223/96, 95, 93, 90, 223/85, 88, 92, 91; D6/315, 326

[56] References Cited

U.S. PATENT DOCUMENTS

| | | | |
|---|---|---|---|
| 2,723,787 | 11/1955 | Bransdorf | 223/93 |
| 3,407,979 | 10/1968 | Patch | 223/88 |
| 4,274,564 | 6/1981 | Warmath | 223/93 |
| 4,438,874 | 3/1984 | Zuckerman et al. | 223/93 X |
| 4,948,019 | 8/1990 | Rodum | 223/94 |
| 4,951,855 | 8/1990 | Jacobson et al. | 223/92 X |

FOREIGN PATENT DOCUMENTS

| | | | |
|---|---|---|---|
| 2128474 | 5/1984 | United Kingdom | 223/85 |
| 2136684 | 9/1984 | United Kingdom | 223/85 |

*Primary Examiner*—Werner H. Schroeder
*Assistant Examiner*—Bibhu Mohanty
*Attorney, Agent, or Firm*—Blum Kaplan

[57] ABSTRACT

An upstanding hanger for the hanging of a garment of the tupe having shoulder straps has a central portion, a hook portion extending upwardly of the central portion and first and second wing portions extending outwardly of respective opposed side margins of the central portion, each wing portion having an end segment inclined downwardly at an acute angle with respect to the wing portion and defining a slot for receipt of a garment shoulder strap. In a second aspect, hangers of the invention having central and wing portions configure the wing portions with end segments which have spring action capacity for retentively notching shoulder straps therein. In a third aspect, hangers of the invention having central and wing portions configure the wing portions with end segments which have the capacity for retaining shoulder straps in one of plural positions relative thereto for more esthetically pleasing display of the garment.

15 Claims, 4 Drawing Sheets

GARMENT HANGER FOR STRAPPED GARMENTS WITH NOTCHING RETENTION

FIELD OF THE INVENTION

This invention relates generally to garment hangers and pertains more particularly to hangers for garments of the type having shoulder straps.

BACKGROUND OF THE INVENTION

In the marketing of garments of the type having shoulder straps, such as brassieres, various forms of hangers are known, such as are shown in U.S. Pat. Nos. 3,738,549, 4,623,079 and 4,828,155, having a hook portion elevated above a central portion, the hanger having the facility for retentively and releasably receiving the bra straps. Such hangers comprise wing portions extending generally horizontally from the central portion, each wing portion having structure at its free end for such bra strap receipt. Ladies' slips and certain evening gowns are likewise hangable, having shoulder straps insertable in the wing portion free end structure.

From applicants' perspective, known hangers for garments of the type having shoulder straps exhibit less than desired garment retention capacity. In one aspect, wing portions of known hangers do not derive benefit of gravity in shoulder strap retention. In another aspect, wing portions of known hangers do not have positive, i.e., spring force, retention capacity. In a further aspect, wing portions of known hangers do not afford the garment seller the facility for retention of shoulder straps in one of plural dispositions for more esthetically pleasing display of the garment.

SUMMARY OF THE INVENTION

The present invention has as its primary object the provision of hangers for improved hanging of garments of the type having shoulder straps.

A more particular object of the invention is to provide hangers having improved facility for the retention of the shoulder straps of garments hung therefrom.

A quite specific object of the invention is the provision of garment hangers adapted to afford the garment seller the facility for retention of shoulder straps in one of plural dispositions for more esthetically pleasing display of the garment.

In attaining the foregoing and other objects, the invention provides an upstanding hanger for the hanging of a garment of the type having shoulder straps, the hanger having a central portion, a hook portion extending upwardly of the central portion and first and second wing portions extending outwardly of respective opposed side margins of the central portion, each wing portion having an end segment inclined downwardly at an acute angle with respect to the wing portion and defining a slot for receipt of a garment shoulder strap.

In a second aspect, hangers of the invention having central and wing portions configure the wing portions with end segments which have spring action capacity for retentively notching shoulder straps therein.

In a third aspect, hangers of the invention having central and wing portions configure the wing portions with end segments which have the capacity for retaining shoulder straps in one of plural positions relative thereto for more esthetically pleasing display of the garment.

In a particularly preferred embodiment, hangers of invention include in their first and second wing portions end segments defining a slot interiorly thereof and a first opening extending downwardly into the slot for insertion of a garment shoulder strap. Each slot has a central open part and at least one open sideward part continuous with the central part through a second opening and adapted for retentively collecting therein a garment shoulder strap received in the central part.

The foregoing and other objects and features of the invention will be further understood from the following detailed description of a preferred embodiment thereof and from the drawings wherein like reference numerals identify like parts throughout.

DETAILED DESCRIPTION OF THE PREFERRED EMBODIMENT

Referring to FIGS. 1–4, hanger 10 is an integral body of synthetic material having a central portion 12, a hook portion H extending upwardly of central portion 12 and first and second wing portions 14 and 16, extending outwardly of respective opposed side margins of central portion 12. First and second wing portions 14 and 16 have respective end segments 18 and 20.

Irrespective of preferred detailed structure for shoulder strap retention below, the downward inclination at an acute angle of the end segments 18 and 20 relative to the wing portions 14 and 16 provides the benefit of gravity in the retention of garment shoulder straps.

Figure 4:
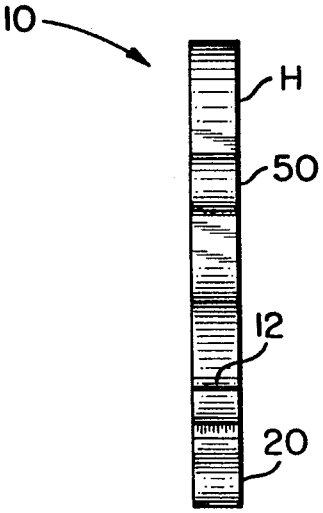
FIG. 4 is a right side elevation of the FIG. 1 hanger.
Figure 2:
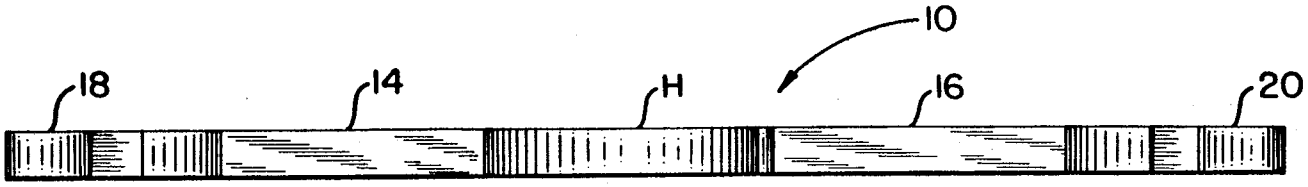
FIG. 2 is a top plan elevation of the FIG. 1 hanger.
Figure 1:
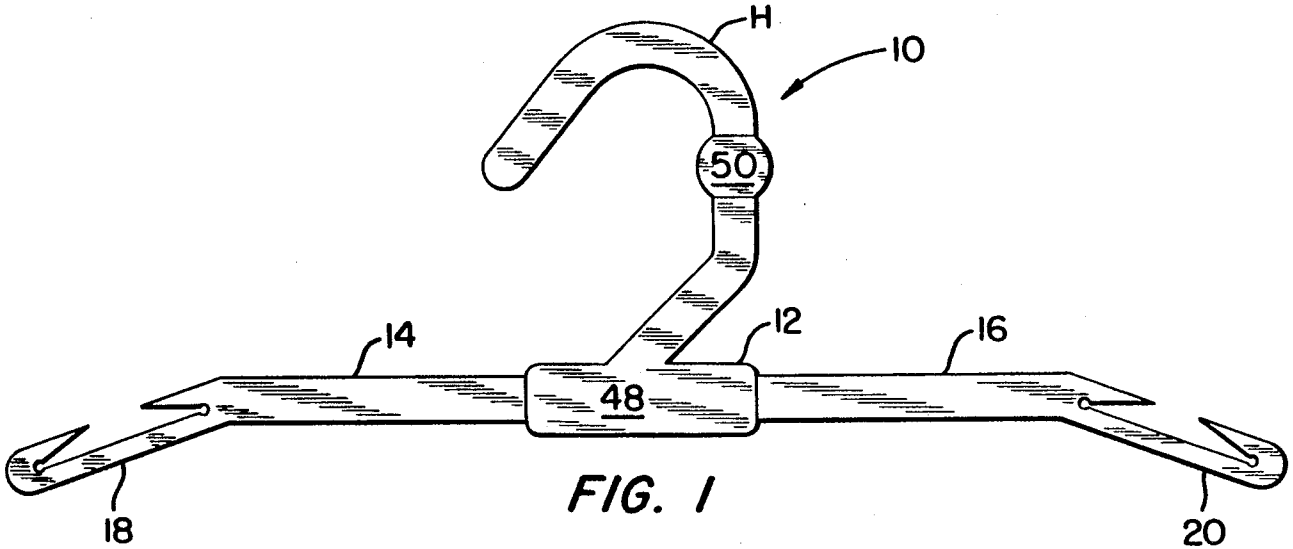
FIG. 1 is a front elevation of a hanger in accordance with the invention.
Figure 3:
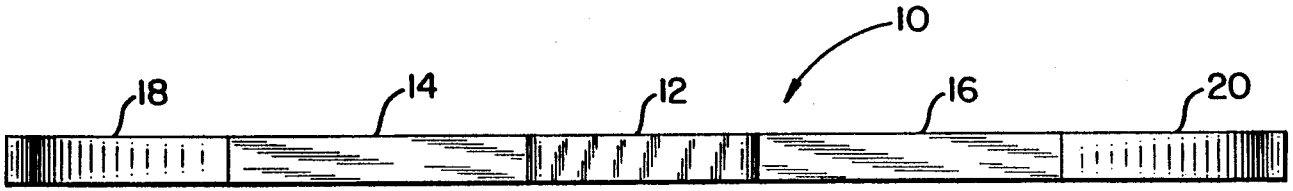
FIG. 3 is a bottom plan elevation of the FIG. 1 hanger.
Figure 5:
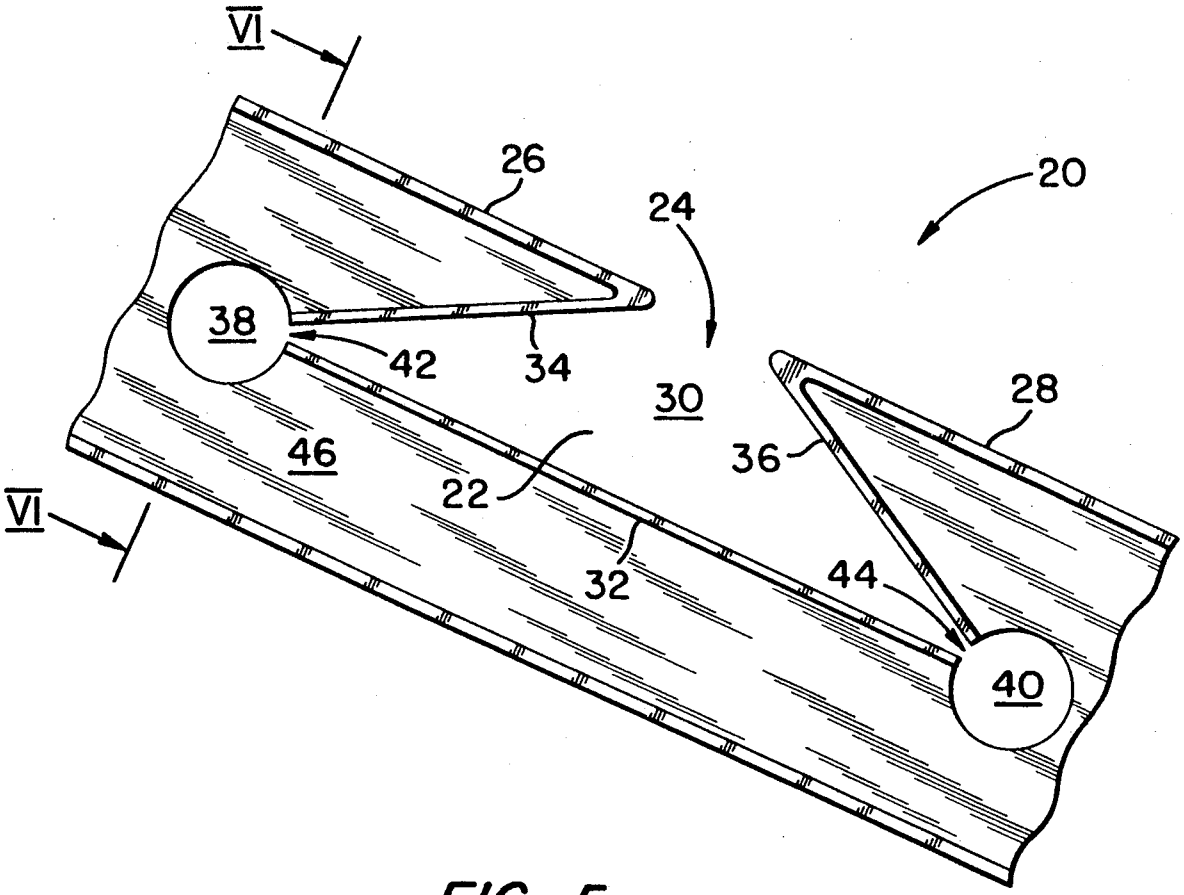
FIG. 5 is an enlarged partial front elevation of the end segment of the right wing portion of the FIG. 1 hanger.
Figure 6:
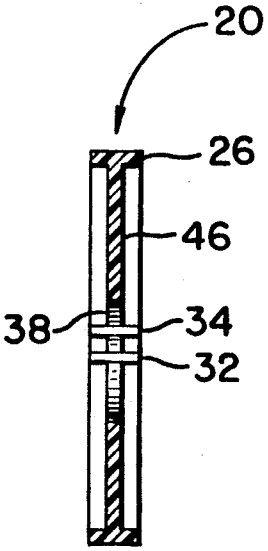
FIG. 6 is a sectional view as would be seen from plane VI—VI of FIG. 5.

The preferred configuration of the end segments will be best seen in the enlarged presentation of FIGS. 5 and 6, which depict end segment 20 in part and to which reference is now made.

End segment 20 defines slot 22 interiorly thereof and a first opening 24 extending downwardly into slot 22 for insertion of a garment shoulder strap. In providing opening 24, end segment 20 has its upper perimeter separated into courses 26 and 28. Slot 22 has a central open part 30 which is bounded by courses 32, 34 and 36. Open sideward parts 38 and 40 are continuous with central open part 30 through openings 42 and 44, which are formed respectively by breaks between courses 32 and 34 and 32 and 36. Openings 42 and 44 are adapted for retentively collecting therein a garment shoulder strap received in central open part 30 as is discussed in connection with FIGS. 7 and 8 below.

Open sideward parts 38 and 40 are preferably of generally circular configuration and are sectorally open to cooperatively define the second opening for such continuity with the open central part 30.

In the preferred configuration for slot 22, as is illustrated in FIG. 5, the slot is of generally triangular configuration having openings 42 and 44 at the respective junctions of the first and second and the second and third sides thereof, which are courses 32, 34 and 36.

The overall hanger configuration preferably has first and second wing portions 14 and 16 extending generally horizontally outwardly of central portion 12, the first and second end segments 18 and 20 extending at acute angles downwardly and outwardly of first and second wing portions 14 and 16.

As is seen in FIG. 6 for courses 26, 32 and 34, they have widths greater than the width of the central planar portion 46 of end segment 20, i.e., the hanger configuration is of I-beam type. This configuration is preferably used throughout the hanger body providing increased rigidity with less material requirements and providing resistance to warpage.

Logo or product information may be placed in area 48 of hanger central portion 12 (FIG. 1) and size information may be placed on hanger hook part 50.

Figure 7:
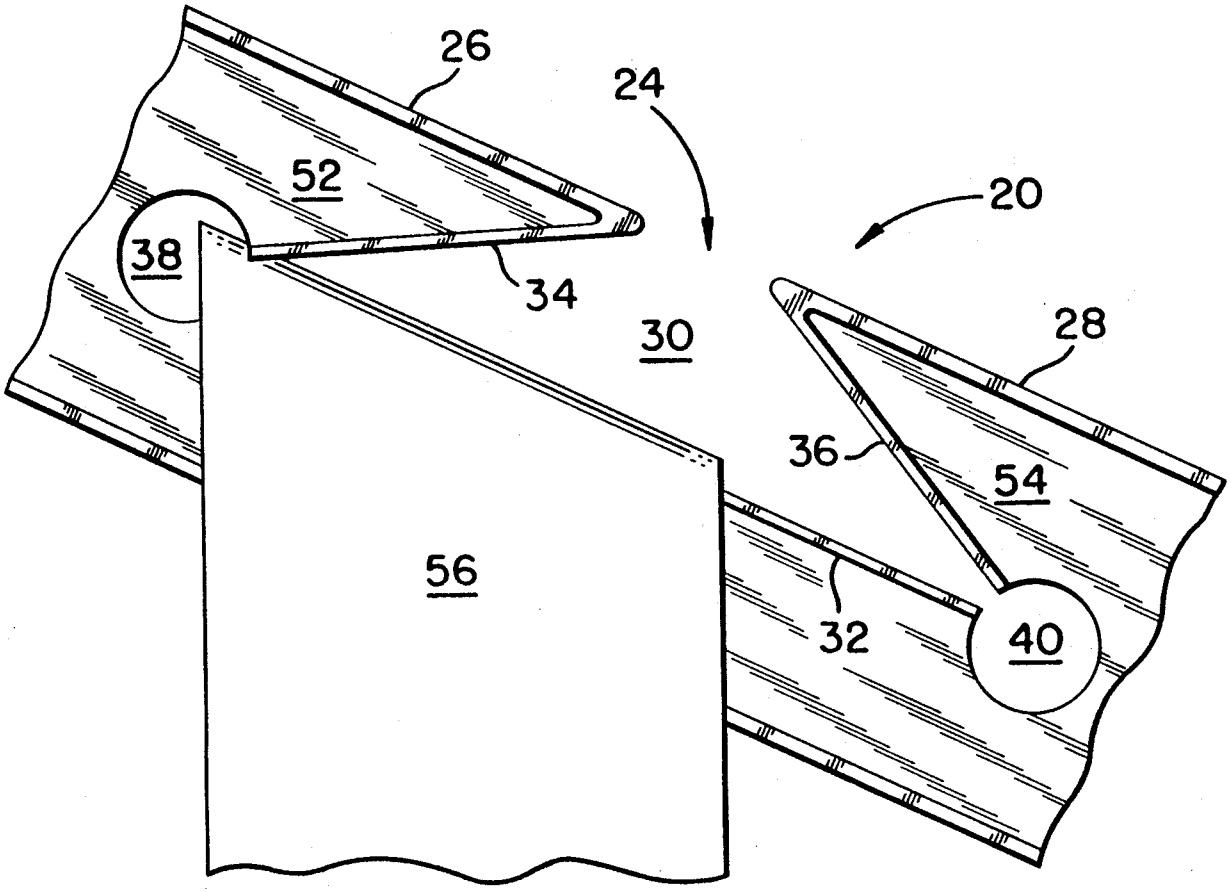
FIGS. 7 and 8 are repeat showings of FIG. 5, illustrating the wing portion end segment in association with inserted garment shoulder straps.
Figure 8:
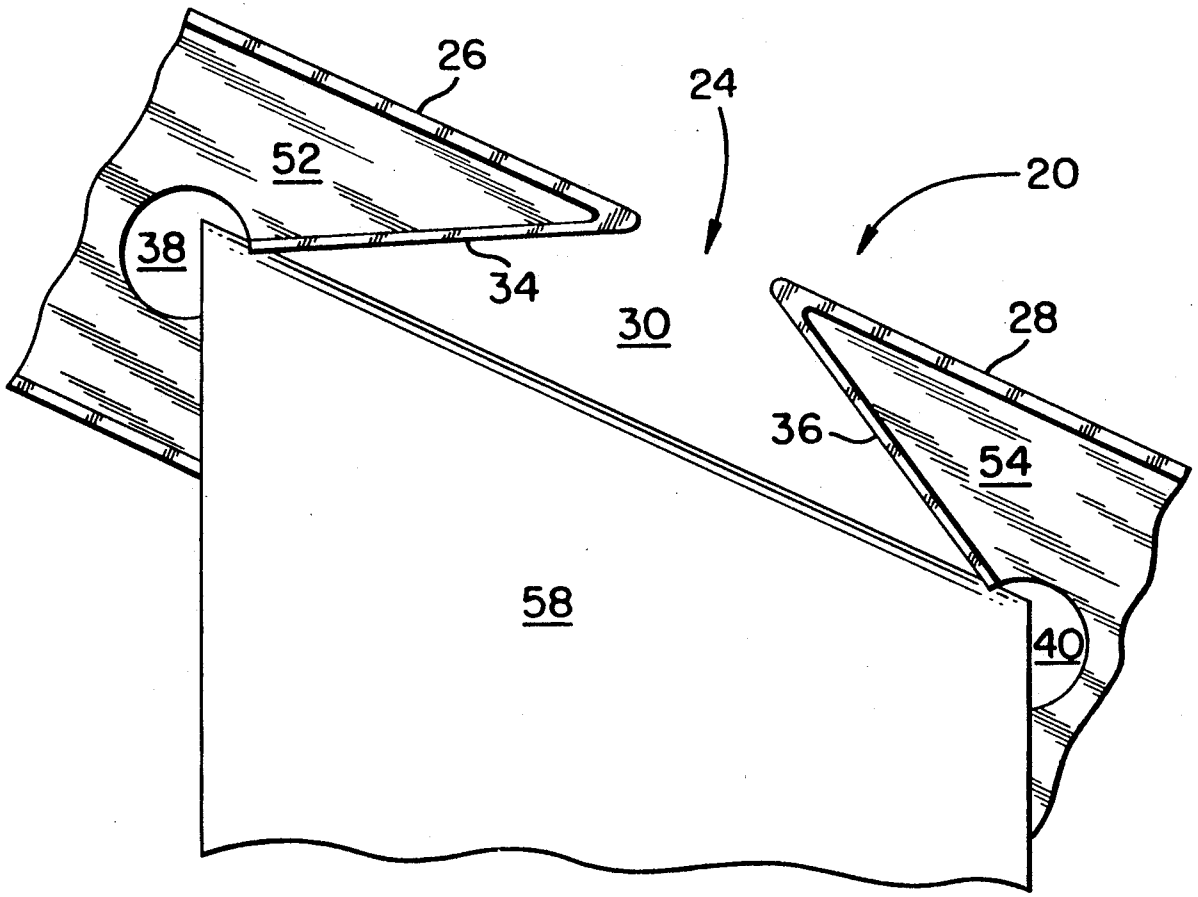

Referring now to FIG. 7, in use of the hanger, arms 52 and 54 are cantilever-supported and are movable upwardly in the plane of FIG. 7, in spring-like manner, to increase the sizes of openings 42 and 44, to permit the insertion of a garment strap therein and therethrough into respective sideward open parts 38 and 40. Certain garments will hang in a more esthetically pleasing manner if hung, as in FIG. 7, i.e., with shoulder strap 56 inserted in inboard sideward open part 38 and notched therein on release of arm 52 from upward movement, the notching being effected by the ends of courses 32 and 34.

Other garments will be best hung by disposition of their shoulder straps in outboard sideward open part 40. For still other garments, e.g., sport bras, which have quite wide shoulder straps, hanging is effected by the use of both the inboard and outboard sideward open parts 38 and 40, such as is shown for shoulder strap 58 in FIG. 8.

Various changes to structure and modifications in practice may be introduced in the foregoing embodiments and practices without departing from the invention. Thus, the particularly discussed and depicted embodiments are intended in an illustrative and not in a limiting sense. The true spirit and scope of the invention is set forth in the following claims.

We claim:

1. An upstanding hanger for the hanging of a garment of the type having shoulder straps, the hanger having a central portion, a hook portion extending upwardly of said central portion and first and second wing portions each having an interior segment extending horizontally outwardly of respective opposed side margins of said central portion, each wing portion having a straight end segment inclined downwardly at an acute angle with respect to said wing portion interior segment and defining a slot interiorly thereof for receipt of a garment shoulder strap, said end segment having first, second and third courses bounding said slot, said second course being fully disposed at said acute angle.

2. The hanger claimed in claim 1 wherein each said end segment includes a first opening extending downwardly into said slot, each said slot having a central open part and at least one open sideward part continuous with said central part through a second opening and adapted for retentively collecting therein a garment shoulder strap received in said central open part.

3. The hanger claimed in claim 2 wherein each said open sideward part is of generally circular configuration and is sectorally open to said second opening.

4. The hanger claimed in claim 2 wherein each said slot is of generally triangular configuration having said first and second openings at respective junctions of said first and said second and said second and said third courses of said end segment.

5. The invention claimed in claim 2 wherein each said end segment has spring action capacity for retentively notching a shoulder strap therein.

6. The invention claimed in claim 5 wherein each said end segment includes an arm bounding said slot and cantilever-supported by said end segment for movement adapted to increase the size of said second opening and adapted to self-biasingly return from such movement to effect said notching of shoulder strap in said second opening.

7. The hanger claimed in claim 1 wherein each said end segment includes a first opening extending downwardly into said slot, each said slot having a central open part and first and second open sideward parts each continuous with said central open part through respective second and third openings and adapted for retentively collecting therein a garment shoulder strap received in said central open part in either of respective plural positions defined by said first and second open sideward parts.

8. The invention claimed in claim 7 wherein each said end segment includes first and second arms bounding said slot and cantilever-supported by said end segment for movement adapted to respectively increase the sizes of said second and third openings and adapted to self-biasingly return from such movement to effect said notching of said shoulder strap in said second and third openings.

9. An upstanding hanger for the hanging of a garment of the type having shoulder straps, the hanger having a central portion, a hook portion extending upwardly of said central portion and first and second wing portions extending outwardly of respective opposed side margins of said central portion, each wing portion having an end segment, each said end segment including a slot and a first opening extending downwardly into said slot, each said slot having a central open part and at least one open sideward part continuous with said central part through a second opening and means for selective notching engagement and retention of a garment shoulder strap received in said central open part.

10. An upstanding hanger for the hanging of a garment of the type having shoulder straps, the hanger having a central portion, a hook portion extending upwardly of said central portion and first and second wing portions each having an interior segment extending horizontally outwardly of respective opposed side margins of said central portion, each wing portion having a straight end segment with a slot therein, each said end segment extending downwardly at an acute angle with respect to said wing portion interior segment, said end segment having spring action capacity for retentively notching a shoulder strap in said slot.

11. The hanger claimed in claim 10 wherein each said end segment includes an arm bounding said slot and disposed at said acute angle, said arm being movable relative to said end segment and self-biasingly returnable from such movement to effect notching of said shoulder strap in said slot.

12. The invention claimed in claim 11 wherein each said end segment includes an opening continuous with said slot, said arm being adapted to increase the size of said opening on such movement.

13. An upstanding hanger for the hanging of a garment of the type having shoulder straps, the hanger having a central portion, a hook portion extending upwardly of said central portion and first and second wing portions each having and interior segment extending outwardly of respective opposed side margins of said central portion, each wing portion having an end segment inclined downwardly at an acute angle with respect to said wing portion interior segment and defining a slot interiorly thereof for receipt of a garment shoulder strap, each said end segment including a first opening extending downwardly into said slot, each said slot having a central open part and first and second open sideward parts each continuous with said central open part through respective second and third openings and with means for retaining therein a garment shoulder strap received in said central open part in either of respective plural positions defined by said first and second open sideward parts.

14. The invention claimed in claim 13 wherein each said end segment includes first and second arms bounding said slot and cantilever-supported by said end segment for movement adapted to respectively increase the sizes of said second and third openings and adapted to self-biasingly return from such movement to effect said notching of said shoulder strap in said second and third openings.

15. An upstanding hanger for the hanging of a garment of the type having shoulder straps, the hanger having a central portion, a hook portion extending upwardly of said central portion and first and second wing portions each having an interior segment extending outwardly of respective opposed side margins of said central portion, each wing portion having an end segment with a slot therein, each said end segment defining notching structure adjacent at least one end of said slot for notching retention of a marginal portion of a shoulder strap introduced in said slot, said slot having a course adjacent said notching structure for supporting the remnant portion of said shoulder strap without notching retention thereof.

* * * * *